US005751070A

United States Patent [19]

Nagao et al.

[11] Patent Number: 5,751,070

[45] Date of Patent: May 12, 1998

[54] COMBINED STARTER AND GENERATOR APPARATUS

[75] Inventors: Yasuhiro Nagao, Okazaki; Tsutomu Shiga, Aichi-ken; Nobuyuki Hayashi, Nagoya, all of Japan

[73] Assignee: Nippondenso Co., Ltd., Kariya, Japan

[21] Appl. No.: 638,332

[22] Filed: Apr. 26, 1996

[30] Foreign Application Priority Data

Apr. 26, 1995 [JP] Japan ..... 7-102189
Mar. 4, 1996 [JP] Japan ..... 8-046030

[51] Int. Cl.[6] ..... F02N 11/04

[52] U.S. Cl. ..... 290/46; 290/31; 74/7 E; 74/7 C

[58] Field of Search ..... 290/46, 31, 34, 290/10, 22; 123/179.28; 192/42; 74/7 C

[56] References Cited

U.S. PATENT DOCUMENTS

| | | | |
|---|---|---|---|
| 3,270,207 | 8/1966 | Stockton | 290/31 |
| 4,114,746 | 9/1978 | Usui et al. | 192/104 R |
| 4,325,265 | 4/1982 | Wakatsuki et al. | 74/7 R |
| 4,712,435 | 12/1987 | Losey et al. | 74/6 |
| 4,744,257 | 5/1988 | Yagasaki et al. | 74/6 |
| 5,126,582 | 6/1992 | Sugiyama | 290/46 |
| 5,269,734 | 12/1993 | Menge, Sr. | 475/339 |
| 5,418,400 | 5/1995 | Stockton | 290/46 |
| 5,474,152 | 12/1995 | Wilkinson et al. | 184/6.12 |

FOREIGN PATENT DOCUMENTS

| | | |
|---|---|---|
| 37-008316 | 4/1962 | Japan . |
| 63-162957 | 7/1983 | Japan . |
| 61-020714 | 5/1986 | Japan . |
| 3-081563 | 4/1991 | Japan . |

*Primary Examiner*—Steven L. Stephan
*Assistant Examiner*—Nicholas Ponomarenko
*Attorney, Agent, or Firm*—Cushman Darby & Cushman IP Group of Pillsbury Madison & Sutro LLP

[57] ABSTRACT

A rotor 2 has a rotary shaft 20. A drive shaft 7 is provided around an outer periphery of rotary shaft 20 and is rotatably supported on a housing. Drive shaft 7 has the same axial center as rotary shaft 20, and has a pinion gear **7*b* meshing with a ring gear 8 of an engine. A speed-reduction mechanism 4 includes a sun gear 2*b* provided on rotary shaft 20, a planetary gear 4*b* meshing with sun gear 2*b*, and an internal gear 4*a* meshing with planetary gear 4*b*. A reduction shaft 5 receives a rotational torque transmitted from rotor 2 through speed-reduction mechanism 4. A first one-way clutch 6*b* is interposed between reduction shaft 5 and drive shaft 7 for connecting reduction shaft 5 to drive shaft 7 only when any rotational torque is transmitted from reduction shaft 5 to drive shaft 7. A second one-way clutch 6*a* is interposed between drive shaft 7 and rotary shaft 20 for connecting drive shaft 7 to rotary shaft 20 only when any rotational torque is transmitted, from drive shaft 7 to rotary shaft 20. In a start-up operation of the engine, rotation of rotor 2 is reduced through speed-reduction mechanism 4 and is transmitted through reduction shaft 5, first one-way clutch 6*b* and drive shaft 7 to ring gear 8 to drive the engine. After succeeding the start-up operation, rotation of ring gear 8 is transmitted through drive shaft 7 and second one-way clutch 6*a* to rotary shaft 20 of rotor 2** to generate electric power.

25 Claims, 3 Drawing Sheets

COMBINED STARTER AND GENERATOR APPARATUS

BACKGROUND OF THE INVENTION

1. Field of the Invention

This invention relates to an improvement of a combined starter and generator (i.e. starter/dynamo) apparatus.

2. Related Art

Among conventional starter/generators, some will be explained hereinafter. Unexamined Japanese Patent Application No. SHO 63-162957, published in 1988, discloses a starter motor. According to this starter motor, a pinion is provided on a pinion shaft. The pinion is always brought into engagement with a ring gear. A pair of first and second gear trains is provided between the pinion shaft and a rotary shaft of the armature (rotor). These pinion shaft and rotary shaft are disposed in parallel with each other. A first one-way clutch, provided in the first gear train, is a torque transmitting device acting only in one direction from the rotary shaft to the pinion. A second one-way clutch, provided in the second gear train, is a torque transmitting device acting only in an opposite direction from the pinion to the rotary shaft. The second gear train has a speed reduction ratio larger than that of the first gear train.

Japanese Utility Model No. SHO 37-8316, published in 1962, discloses another type starter/dynamo. An armature is supported by a bearing. A small gear, provided at a remote end of a rotary shaft of the armature, meshes with a planetary gear supported on a planetary gear shaft. The planetary gear meshes with an internal gear. One end of the planetary gear shaft is connected to a flange of a pulley shaft. An over-running clutch (second one-way clutch) is interposed between the rotary shaft and the planetary gear shaft. Another over-running clutch (first one-way clutch) is interposed between a boss portion of the internal gear and a housing case. A pulley is provided on the other end of the pulley shaft. An endless V belt is entrained between the pulley and an engine.

However, according to the starter motor disclosed in Unexamined Japanese Patent Application No. SHO 63-162957, the radial size of this starter motor is inherently large because of the arrangement of the first and second gear trains provided between the rotary shaft and the pinion shaft. If this starter motor is installed on an engine, it will be a higher possibility that the starter motor would interfere with auxiliary devices of the engine.

According to the starter/dynamo disclosed in Japanese Utility Model No. SHO 37-8316, in an engine start-up operation, the second one-way clutch is maintained in a slipping condition while the first one-way clutch is engaged. Rotation of the rotary shaft of the armature is reduced through the small gear and the planetary gear, and is then transmitted through the planetary gear shaft, the pulley shaft, the pulley and the V belt to the engine. After succeeding the engine start-up operation, rotation of the engine is transmitted through the V belt, the pulley, the pulley shaft, the planetary gear shaft and the second one-way clutch to the rotary shaft of the armature.

According to this arrangement, after succeeding the engine start-up operation, the load for driving the engine is reduced to zero and the starter/dynamo is driven by the engine. The rotation of the armature increases up to the no-load rotational speed of the starter/dynamo. If the rotational speed of the pulley shaft is increased so much that it exceeds a value equivalent to the reduced no-load speed of the armature which is obtained through the speed-reduction mechanism, the first one-way clutch disengages the internal gear from the housing and starts slipping.

The first and second one-way clutches continue slipping until the rotational speed of the pulley shaft is equalized with the rotational speed of the armature shaft, absorbing mutual rotation between the internal gear, the pulley shaft and the armature shaft.

If the rotational speed of the pulley shaft increases and exceeds the no-road rotational speed of the armature, the second one-way clutch will be engaged with the rotary shaft. The small gear of the armature shaft, the planetary gear and the internal gear integrally rotate without causing mutual slip therebetween.

In other words, the first one-way clutch causes slip to absorb mutual rotation between the internal gear and the housing. The internal gear rotates at the same speed as the pulley shaft driven by the engine, while the housing is stationary.

According to the Japanese Utility Model No. SHO 37-8316, the same pulley is used to drive the engine and to drive the starter/dynamo. Normally, a torque required to drive the engine is fairly large compared with a torque generated from the starter/dynamo. Thus, it is definitely necessary to use a smaller-diameter pulley for the starter/dynamo while using a larger-diameter pulley for the engine. When the starter/dynamo is driven by the engine, the pulley shaft rotates at a speed faster than the engine speed due to the above-described pulley ratio.

Furthermore, the engine has ordinary operating speeds extremely higher than the speeds obtained by the starter/dynamo. This will cause a large speed difference between the stationary housing and the internal gear. It may results in a damage of the first one-way clutch.

SUMMARY OF THE INVENTION

Accordingly, in view of above-described problems encountered in the related art, a principal object of the present invention is to provide a combined starter and generator which is small in a radial size, and capable of preventing a clutch from being damaged when this clutch is used to transmit the rotation of an armature to a ring gear.

In order to accomplish this and other related objects, the present invention provides a novel and excellent starter/generator comprising a rotor, a drive shaft, a speed-reduction mechanism, a reduction shaft, a first one-way clutch, and a second one-way clutch. The rotor has a rotary shaft. The drive shaft is provided around an outer periphery of the rotary shaft and is rotatably supported on a housing. The drive shaft has the same axial center as the rotary shaft and has a pinion gear meshing with a ring gear of an engine. The speed-reduction mechanism includes a sun gear provided on the rotary shaft, a planetary gear meshing with the sun gear, and an internal gear meshing with the planetary gear. The reduction shaft receives a rotational torque transmitted from the rotor through the speed-reduction mechanism. The first one-way clutch is interposed between the reduction shaft and the drive shaft for connecting the reduction shaft to the drive shaft only when any rotational torque is transmitted from the reduction shaft to the drive shaft. The second one-way clutch is interposed between the drive shaft and the rotary shaft for connecting the drive shaft to the rotary shaft only when any rotational torque is transmitted from the drive shaft to the rotary shaft.

With this arrangement, in a start-up operation of the engine, rotation of the rotor is reduced through the speed-reduction mechanism, and is transmitted through the reduction shaft, the first one-way clutch and the drive shaft to the ring gear to drive the engine. On the other hand, after succeeding the start-up operation, rotation of the ring gear of the engine is transmitted through the drive shaft and the second one-way clutch to the rotary shaft of the rotor to generate electric power.

According to the features of preferred embodiments of the present invention, the pinion gear and the ring gear are constituted by helical gears or double-helical gears. It is preferable to additionally provide a lubrication oil supply means for supplying lubrication oil to frictional surfaces of the pinion gear and the ring gear. In this case, the lubrication oil supply means comprises an oil reservoir having an upper opening and formed integrally with the housing. The oil reservoir is disposed under the ring gear so as to cover the pinion gear.

Furthermore, according to the features of the preferred embodiments of the present invention, the rotor is stored in a rotor accommodating space into which lubrication oil is supplied. The housing is connected to an engine block, and the rotor accommodating space is communicated with a lubrication oil passage in the engine block through a lubrication passage opened on a connecting surface of the housing.

Furthermore, there is provided a rotor speed restricting means for preventing the speed of the rotor from exceeding a predetermined upper limit. The rotor speed restricting means is formed integrally with the second one-way clutch.

Preferably, the rotor speed restricting means comprises a tube, a weight, a first urging means and a second urging means. More specifically, the tube is engaged with the rotary shaft of the rotor so as to cause no rotational displacement therebetween but allowing a mutual displacement therebetween in an axial direction. The tube is engaged with an inner conical surface of the pinion gear through a clutch roller so as to receive a rotational torque from the pinion gear but transmitting no torque to the pinion gear. The weight has a slant face mating with a slant face formed on one end of the tube. The weight is engaged with the rotary shaft of the rotor so as to cause no rotational displacement therebetween but allowing a shift movement along the slant face of the tube. The first urging means urges the weight in a centripetal direction. The second urging means urges the weight along the slant face of the tube.

The tube has a conical surface brought into contact with the clutch roller. A distance from a point on the conical surface to an axis of the tube increases with decreasing distance from the point to the slant face of the tube.

In a preferable mode of the combined starter and generator in accordance with the present invention, the drive shaft is configured into a hollow cylinder having the same axial center as the rotary shaft and having a pinion gear meshing with a ring gear of an engine. The reduction shaft is configured into a hollow cylinder and coupled around the rotary shaft. The reduction shaft is disposed adjacently to the speed-reduction mechanism. The first one-way clutch is interposed between an outer cylindrical surface of the reduction shaft and an inner cylindrical surface of the drive shaft. The drive shaft is disposed adjacently to the reduction shaft. The second one-way clutch is interposed between an inner cylindrical surface of the drive shaft and an outer cylindrical surface of the rotary shaft.

BRIEF DESCRIPTION OF THE DRAWINGS

The above and other objects, features and advantages of the present invention will become more apparent from the following detailed description which is to be read in conjunction with the accompanying drawings, in which.

DETAILED DESCRIPTION OF THE PREFERRED EMBODIMENTS

Figure 1:
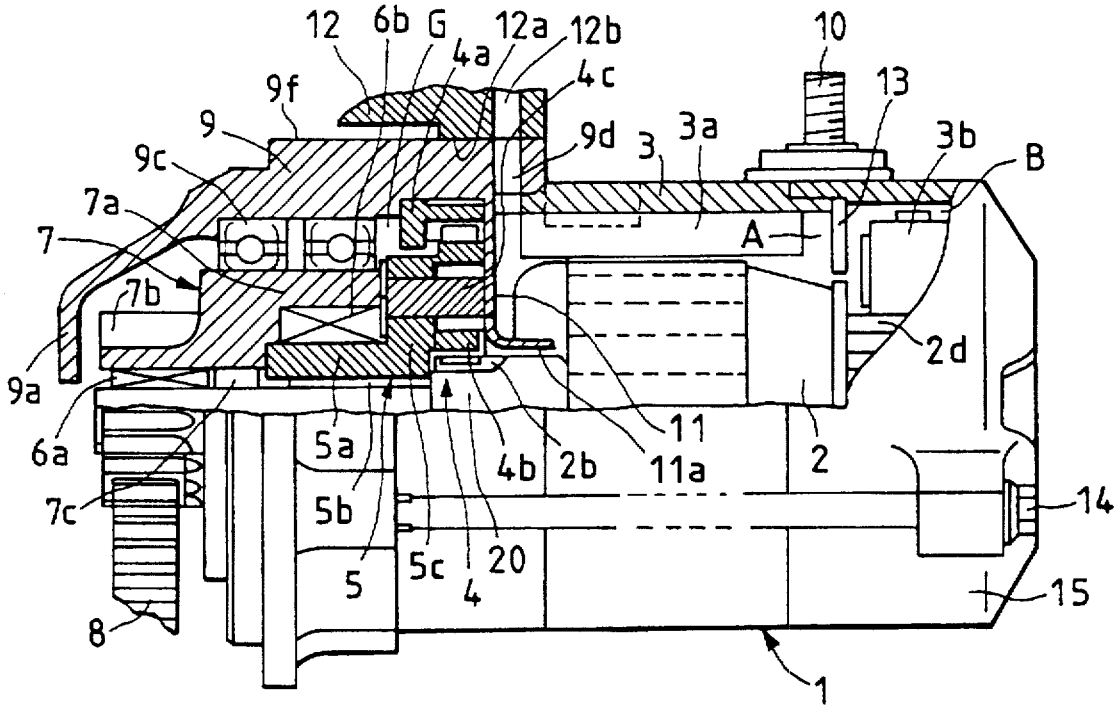
FIG. 1 is a partly sectional view showing an arrangement of a preferred embodiment of a combined starter and generator apparatus in accordance with the present invention.

Preferred embodiments of the present invention will be explained in greater detail hereinafter, with reference to the accompanying drawings. Identical parts are denoted by the same reference numeral throughout views.

First Embodiment

In FIG. 1, a combined starter and generator apparatus (hereinafter referred to as "starter/dynamo") comprises a cylindrical frame 9 fixed to an engine block 12. A planetary speed-reduction mechanism 4, a drive shaft 7, a one-way clutch **6*a* for use in a generating phase, and a one-way clutch 6*b* for use in an engine start-up phase are accommodated in the cylindrical frame 9. A DC machine is fixed to the rear side of frame 9. The DC machine comprises a cylindrical yoke 3 having openings at front and rear ends, and an end frame 15 coupled with the rear end of the yoke 3. End frame 15 and yoke 3 are securely fixed to the frame 9 by means of a through bolt 14**.

A partition plate 13 is interposed between the yoke 3 and the end frame 15. The partition plate 13 defines an armature accommodating space (i.e. rotor accommodating space) "A" inside the yoke 3 and a commutator accommodating space "B" inside the end frame 15.

A partition plate 11 is interposed between frame 9 and yoke 3. The partition plate 11 defines a gear chamber "G" inside the frame 9, next to the armature accommodating space "A" in the yoke 3. Frame 9, yoke 3 and end frame 15 cooperatively constitute a housing of the starter/armature.

Along the inner surface of yoke 3, an even number of permanent magnets (fields) **3*a* are disposed or aligned in a circumferential direction, so that their polarities are arranged in an alternating pattern. An armature (rotor) 2 is fixed to a rotary shaft 20 and is surrounded by permanent magnets 3*a*. The rear end of rotary shaft 20 is supported by the end frame 15 through a bearing (not shown). Reference numeral 2*d* represents a cylindrical commutator, reference numeral 3*b* represents a brush, and reference numeral 10** represents a terminal connected to the brush.

The inner end of partition plate 11 is bent perpendicularly so as to form a cylindrical inner peripheral end **11*a* extending toward armature 2. The rotary shaft 20 is inserted into the inner peripheral end 11*a* of the partition plate 11** with a tiny clearance therebetween. With this arrangement, the armature accommodating space "A" is closed hermetically.

The rotary shaft 20, extending into the gear chamber "G", is formed with a sun gear **2*b* at a portion near the partition plate 11. The sun gear 2*b* meshes with a planetary gear 4*b*. The planetary gear 4*b* meshes with a cylindrical internal gear 4*a* surrounding the planetary gear 4*b***. The internal gear 4a is fixed to the inner surface of the frame 9. The planetary gear 4b is rotatably supported by a pin 4c. The pin 4c is fixed to a flange 5c of a reduction shaft 5. The reduction shaft 5, configured into a hollow cylinder and disposed adjacently to and in front of the sun gear 2b, is rotatably coupled with the rotary shaft 20.

A drive shaft 7 is disposed adjacently to and in front of the reduction shaft 5. The drive shaft 7 is configured into a hollow cylinder and is rotatably coupled with the rotary shaft, 20. Reference numerals 7c and 5b represent bearings.

The drive shaft 7 has a boss portion 7a surrounding an outer cylindrical surface of a cylindrical portion 5a of the reduction shaft 5. The boss portion 7a is rotatably supported by the inner surface of frame 9 through bearing 9c. The inner surface of boss portion 7a is connected to the outer surface of cylindrical portion 5a of reduction shaft 5 through the one-way clutch 6b for use in the engine start-up phase.

The one-way clutch 6b, active in the engine start-up phase, has a clutch roller (not shown). An inner cylindrical surface of boss portion 7a or an outer cylindrical surface of reduction shaft 5 is formed with a cam surface, which is engageable with the clutch roller of one-way clutch 6b so as to transmit a start-up torque but transmitting no torque opposed to the start-up torque.

The one-way clutch 6a, active in the generating phase, is interposed between the front end of an inner cylindrical surface of the drive shaft 7 and the front end of an outer cylindrical surface of the rotary shaft 20. The one-way clutch 6a has a function of suppressing the amount of a torque transmissible in a high speed region as described later. This one-way clutch 6a serves as an armature speed restricting means in the present invention. Furthermore, a gear portion (pinion gear) 7b is formed on the front end of an outer cylindrical surface of drive shaft 7. Gear portion 7b is always meshed with a ring gear 8.

Figure 2:
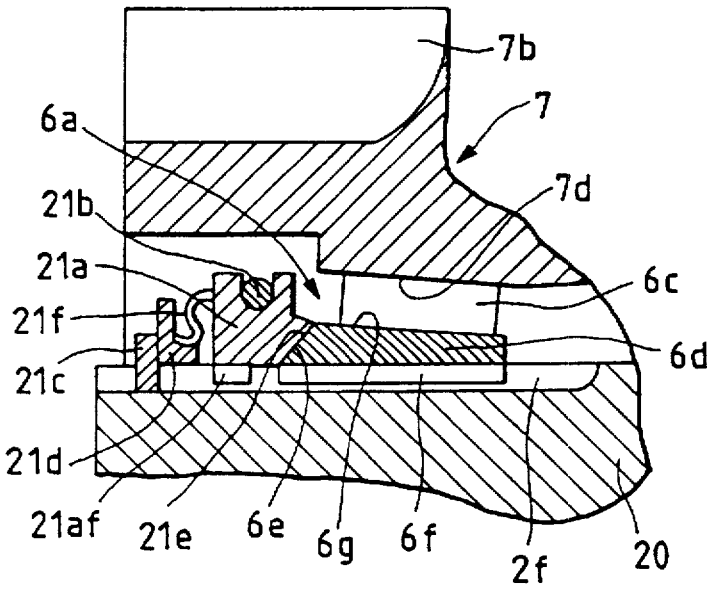
FIG. 2 is a cross-sectional view enlargedly showing an essential part of FIG. 1.

Detailed structure of the one-way clutch 6a for use in the generating phase will be explained with reference to FIG. 2.

The one-way clutch 6a comprises a clutch roller 6c, a tube 6d, a weight 21a, a garter spring 21b and an elastic member 21f. The tube 6d, formed into a shape similar to a truncated cone, is engaged with the rotary shaft 20 and is displaecable in the axial direction of the rotary shaft 20. A serration 6f is formed on an inner cylindrical surface of tube 6d. The serration 6f is engaged with a mating serration 2f formed on the rotary shaft 20 of armature 2, thereby preventing tube 6d from rotating about the rotary shaft 20.

An outer conical surface 6g of tube 6d is disposed in a confronting relation with an inner conical surface 7d of drive shaft 7, through clutch roller 6c. With this arrangement, a generator torque (i.e. a torque used for electric power generation) is transmitted from drive shaft 7 to tube 6d through clutch 6c, while a non-generator torque opposed to the generator torque is not transmitted through clutch 6c.

A distance between a point on the outer conical surface 6g of tube 6d to an axis of tube 6d (i.e. an axis of rotary shaft 20) decreases as the point approaches to the rear end of tube 6d. Similarly, a distance between a point on the inner conical surface 7d to the axis of tube 6d decreases as the point approaches to the rear end of tube 6d. In other words, the inner conical surface 7d is formed into a shape similar to the outer conical surface 6g.

The weight 21a, constituted by a plurality of split cylinders, is engaged with the rotary shaft 20 of armature 2 so as to be slidable in the axial direction thereof. A serration 21af is formed on an inner cylindrical surface of weight 21a. The serration 21af is engaged with the serration 2f formed on the rotary shaft 20 of armature 2, so as to prevent the weight 21a from rotating about the rotary shaft 20.

The garter spring 21b, inserted or engaged in a circular or ring groove formed on the outer surface of weight 21a, acts as a means for urging the weight 21a in a radially compressing direction (i.e. in a centripetal direction). The urging force of the garter spring 21a is balanced with a centrifugal force of the weight 21a at a predetermined rotational speed. The weight 21a has a slant face 21e at the rear end thereof. The tube 6d has a slant face 6e at a front end thereof. The inclination of slant face 21e is identical with that of slant face 6e, so that the weight 21a is just fitted to the front end of tube 6d at these slant faces 21a and 6e.

A washer 21d, which is stopped by a snap ring 21c, is provided on rotary shaft 20. The elastic member 21f has one end supported by the washer 21d and the other end abutting the weight 21a. The resilient force of elastic member 21f is used to urge the weight 21a toward the tube 6d. With this arrangement, clutch roller 6c is firmly pressed between the outer conical surface 6g of tube 6d and the inner conical surface 7d of drive shaft 7.

Next, an operation of one-way clutch 6a for use in the generating phase will be explained.

In an engine start-up operation, the rotation of reduction shaft 5 is transmitted through the one-way clutch 6b to the drive shaft 7. The rotational speed of rotary shaft 20 always exceeds that of drive shaft 7. The clutch roller 6c is displaced in the left direction in FIG. 2, so that the clearance between the inner conical surface 7d and the outer conical surface 6g is increased. In this condition, no substantial torque transmission is carried out through one-way clutch 6a.

After succeeding the firing of the engine, the rotational speed of drive shaft 7 is increased. If the rotational speed of drive shaft 7 is equalized with that of rotary shaft 20, the one-way clutch 6a will no longer cause slipping. Hence, the engine torque is directly transmitted through drive shaft 7, clutch 6a to rotary shaft 20, thereby starting the generating operation.

When the engine speed increases so much that it exceeds a predetermined rotational speed, the centrifugal force of weight 21a exceeds the load (centripetal urgent force) of garter spring 21b. The weight 21a shifts obliquely upwardly along the slant face 6e of the tube 6d. Hence, the pressing force transmitted from elastic member 21f to the tube 6d is reduced, allowing the tube 6d to slide to the left. The transmission of one-way clutch 6a is reduced.

If the engine speed further increases, the engine torque transmitted through drive shaft 7 will be equalized with an upper limit of a torque transmissible through clutch 6a. After reaching this upper limit, the one-way clutch 6a starts slipping. Hence, the rotational speed of armature 2 is no more increased even if the engine speed is further increased. The rotation of armature 2 is, hence, maintained at a predetermined speed.

As a result, even if the engine speed exceeds the predetermined threshold, the generated output voltage of the permanent field type DC generator is suppressed within an allowable limit of the battery. Charging operation is adequately performed without causing excessive charging.

A ratchet type clutch may be used as the mechanism for limiting a generator torque in a high speed region.

Figure 3:
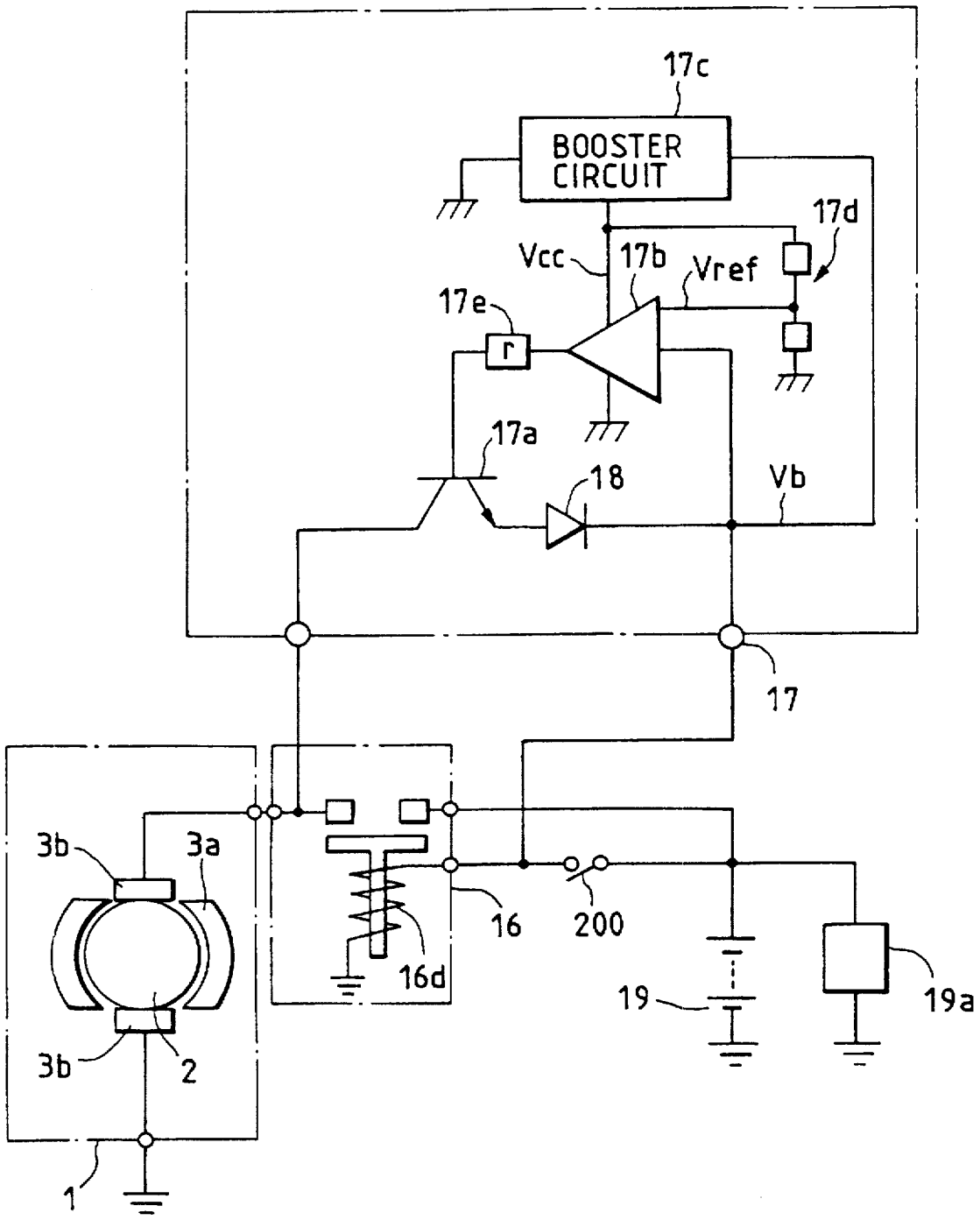
FIG. 3 is a diagram showing a circuit arrangement of the combined starter and generator apparatus shown in FIG. 1.

Next, an electric circuit of the starter/dynamo in this embodiment will be explained with reference to FIG. 3.

The electric circuit of the starter/dynamo of this embodiment comprises a rotation mechanism portion 1, a starter relay 16 and a controller 17.

One brush 3b is grounded, and the other brush 3b is connected to high-voltage terminals of a battery 19 and an electric load 19a through a main contact pair of the starter relay 16. The high-voltage terminal of battery 19, i.e. the high-voltage terminal of electric load 19a, is connected through a key switch 200 to an exciting coil 16d of starter relay 16 to supply electric power to the exciting coil 16d.

The other brush 3b is connected to both battery 19 and electric load 19a through a power transistor 17a and a diode 18 in the controller 17, to supply generated electric current to the high-voltage terminals of battery 19 and electric load 19a.

In the controller 17, a comparator 17b compares a battery voltage Vb with a reference voltage Vref, to generate an output voltage which is applied through a resistance 17e to a base of transistor 17a. A booster circuit 17c, which is a DC-DC converter, increases the battery voltage Vb to supply a power voltage Vcc to the comparator 17b. On the other hand, the output of booster circuit 17c is applied to a voltage dividing circuit 17d which generates the reference voltage Vref. It may be possible to obtain the power voltage Vcc and the reference voltage Vref of comparator 17b from an external device, such as an engine control unit (ECU). In such a case, the booster circuit 17c and the voltage dividing circuit 17d can be omitted.

An operation of controller 17 will be explained hereinafter. When the generating operation is not performed, or when the generated voltage is lower than a sum of the battery voltage Vb and a connecting voltage drop, the diode 18 prevents current from flowing from the battery 19 to the rotation mechanism portion 1. When the battery voltage Vb is larger than the connecting voltage drop, the comparator 17b turns off the power transistor 17a. When the battery voltage Vb is smaller than the connecting voltage drop, the comparator 17b turns on the power transistor 17a. When the generated voltage exceeds the sum of battery voltage Vb and the connecting voltage drop, power transistor 17a intermittently flows the generated power current to the electric load 19a and charges the battery 19 at a predetermined level.

Next, an overall operation of the above-described starter/dynamo will be explained. When the key switch 200 is turned on in an engine start-up operation, the exciting coil 16d of starter relay 16 is activated, thereby turning on the starter relay 16. Electric power is supplied from battery 19 through starter relay 16 to the brush 3b of the rotation mechanism portion 1. The motor (i.e. armature 2) starts rotating. The rotational force of armature 2 is transmitted from sun gear 2b of rotary shaft 20 to reduction shaft 5 through planetary speed-reduction mechanism 4. In other words, the torque of armature 2 is amplified through the planetary speed-reduction mechanism 4. Thus amplified torque is transmitted, as a start-up torque, to the drive shaft 7 through the one-way clutch 6b. A large rotational force is transmitted from the gear portion (pinion gear) 7b to the ring gear 8, thereby driving or starting up the engine. In this case, one-way clutch 6a maintains a slipping condition since the rotational speed of drive shaft 7 is smaller than that of rotary shaft 20.

After succeeding the firing of the engine, the engine increases its rotational speed. When the rotation of drive shaft 7 is increased and equalized with the rotation of rotary shaft 20 of armature 2, the one-way clutch 6a stops slipping and rotates integrally (in a one-to-one ratio) with the drive shaft 7. When the rotational speed reaches a predetermined rotational speed, the electric power generating operation is started. In this moment, the other one-way clutch 6b is maintained in a slipping condition. It surely prevents the rotary shaft 20 of armature 2 from rotating at a speed faster than the rotational speed of drive shaft 7. In other words, the one-way clutch 6b prevents the armature 2 from being damaged.

If the engine speed is accidentally increased, the one-way clutch 6a functions as a torque limiting means. The one-way clutch 6a suppresses the torque to be transmitted to the rotary shaft 20 for the electric power generation within a predetermined value. Hence, the generated output of the motor can be suppressed within an adequate voltage range.

Next, a cooling mechanism of armature 2 will be explained with reference to FIG. 1.

The frame 9 has a flat installation surface 9f through which the housing of rotation mechanism portion 1 is installed to the engine block 12. The flat installation surface 9f is brought into contact and fixed with a flat installation surface 12a of engine block 12 through a packing (not shown). The engine block 12 has an oil passage 12b extending from the inside and opening to the flat installation surface 12a. The frame 9 has an oil passage 9d extending from the inside (i.e. armature accommodating space "A") and opening to the flat installation surface 9f. The oil passage 12b of engine block 12 is communicated with the armature accommodating space "A" through oil passage 9d of frame 9.

Thus, an adequate amount of engine oil is supplied from the engine block 12 through these oil passages 12b and 9d to the armature accommodating space "A". The introduced engine oil flows through the gap of poles of the permanent magnet, and the clearance between the field and the armature, thereby cooling the armature 2. Then, engine oil returns to an oil pan of the engine through a drain passage (not shown) provided under the yoke 3 or frame 9.

With this cooling arrangement, the armature 2 can be sufficiently cooled down. There is no necessity of introducing external air into the armature accommodating space "A". Accordingly, it becomes possible to prevent the inside space from being contaminated by dusts etc. and also it becomes possible to realize the downsizing and weight reduction of the starter/dynamo.

Reference numeral 9a represents a hood of frame 9. The hood 9a is extended from the installation surface 9f to the left (i.e. front) side of the starter/armature, so as to cover the gear portion (i.e. pinion) 7b of the drive shaft 7.

According to this embodiment, it is not necessary to separate the drive shaft 7 from the ring gear 8, even after the start-up operation is succeeded. Hence, this embodiment makes it possible to constitute these drive shaft 7 and the ring gear 8 by helical gears or double-helical gears which are excellent in efficiency and noiselessness.

Furthermore, according to this embodiment, the rotary shaft 20 of armature 2 is coupled into the axial through-holes of reduction shaft 5 and drive shaft 7. Two one-way clutches 6a and 6b are disposed in the axial space available between these rotary shaft 20, reduction shaft 5 and drive shaft 7. Accordingly, this embodiment makes it possible to provide a starter/dynamo compact in size.

Second Embodiment

Figure 4:
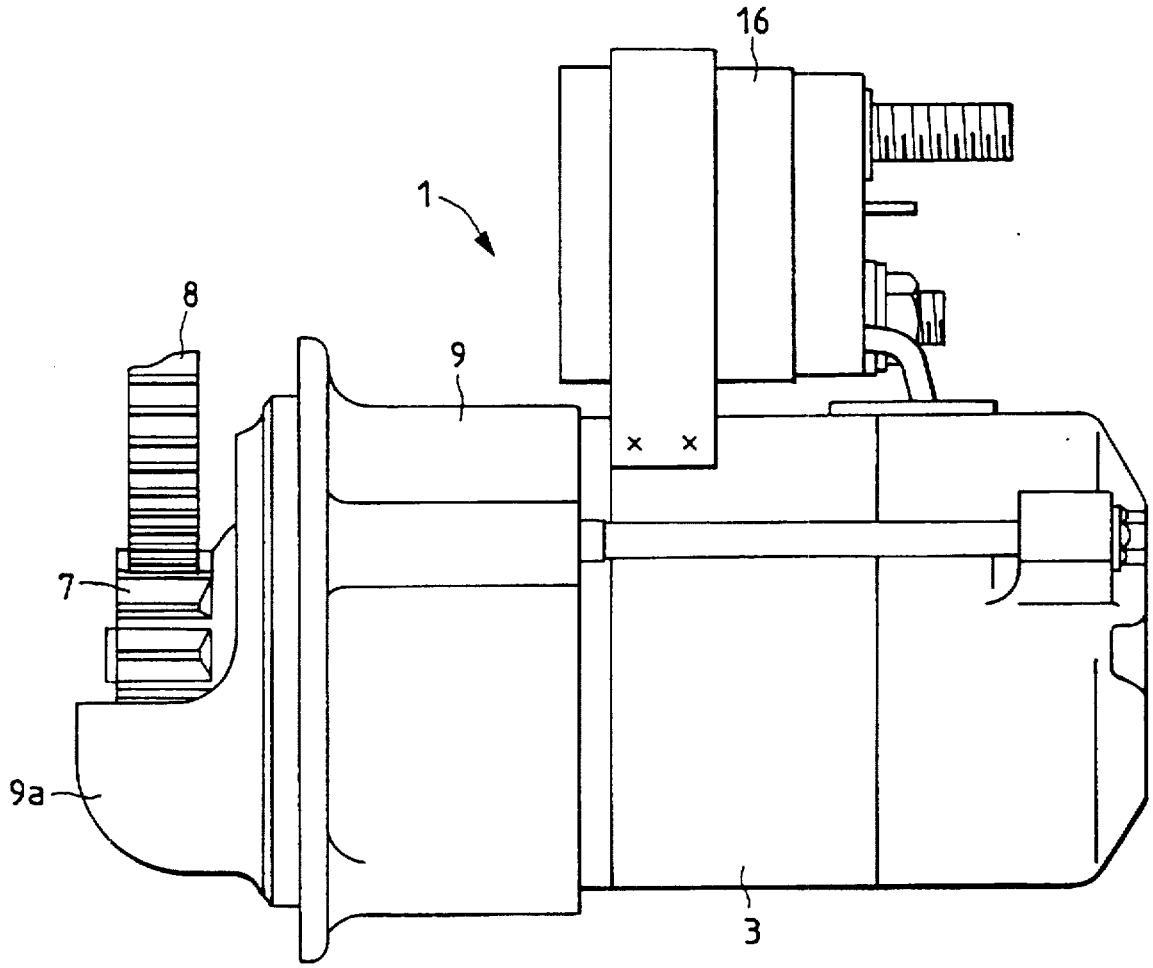
FIG. 4 is a side view showing another embodiment of a combined starter and generator in accordance with the present invention.

Another embodiment of the present invention will be explained with reference to FIG. 4.

The second embodiment is different from the first embodiment in that the starter/armature of the first embodiment is disposed upside down and in that the starter relay 16 is directly connected to the yoke 3.

More specifically, the second embodiment is characterized in that the hood 9a of frame 9 not only covers the drive shaft 7 but serves as an oil reservoir. The engine oil, once supplied into the armature accommodating space A, flows into the hood 9a through passages (not shown). The hood 9a is filled with a sufficient amount of engine oil to lubricate the drive shaft 7 and the ring gear 8. Surplus of engine oil is returned from this hood 9a to the oil pan of the engine.

In this embodiment, it will be desirable to provide an aluminum cover or the like to conceal the ring gear 8 and the drive shaft 7 therein to prevent engine oil from spraying out.

Furthermore, it will be possible to use a permanent magnet rotary type synchronous motor to eliminate any interruption of commutation due to undesirable engine oil flow into the commutator accommodating space "B". Although the bearing 9c is an oil-shield type bearing, it will be possible to replace it by a metal bearing.

Hereinafter, various effects of above-described embodiments will be explained.

Torque transmission by the combination of ring gear 8 and drive shaft 7 is advantageous in the capability of transmitting a large torque when it is compared with the torque transmission by a combination of a V belt and pulleys which tends to cause a slipping in a large torque transmission. Thus, it becomes possible to realize a large speed-reduction ratio. In other words, the output torque of rotary shaft 20 can be reduced. It will lead to a reduction of an overall size of the starter/dynamo.

The embodiments of the present invention can maintain the compatibility with the conventional starter in its installation and also maintain the flywheel effect of ring gear 8, without requiring major changes to the apparatus. Furthermore, the embodiments of the present invention allow the drive shaft 7 to be always meshed with the ring gear 8. Thus, it becomes possible to constitute the drive shaft 7 and ring gear 8 by helical gears or double helical gears which were not used in the conventional starters. Noise reduction and gear durability will be greatly improved.

Furthermore, the embodiments of the present invention comprise a speed-reduction mechanism (planetary gear arrangement) including the sun gear 2b provided on the rotary shaft 20, the planetary gear 4b meshing with the sun gear 2b, and the internal gear 4a meshing with the planetary gear 4b. This speed-reduction mechanism is exclusively used for reducing the speed of armature 2 to provide an amplified start-up torque to the engine. Thus, it becomes possible to further reduce the overall size and weight of the apparatus.

The embodiments of the present invention provide two one-way clutches to change the speed-reduction ratio in input and output stages. The speed ratio reduction between the engine and the starter/dynamo, and the speed ratio reduction in the internal planetary gear arrangement, are both realized by the combination of gears. The range selectable by the combination of gears is wide; therefore, it becomes possible to satisfy both the requirements from the starter and the requirements from the dynamo.

The embodiments of the present invention provide the one-way clutch 6a in a space available between the drive shaft 7 and the rotary shaft 20 of armature 2. This one-way clutch 6a is active in the generating phase. In other words, the one-way clutch 6a can be installed in a dead space. The arrangement of the embodiments of the present invention is advantageous in view of space utility and, therefore, contributes the downsizing of the apparatus. A smaller-diameter portion of the shaft, not used in the driving condition, is sufficiently long to absorb the shock caused when the engine speed changes.

Yet further, the embodiments of the present invention provide the one-way clutch 6b between the drive shaft 7 and the planetary speed-reduction mechanism 4. This one-way clutch 6b is active in the engine start-up phase. Provision of the one-way clutch 6b makes it possible, after the engine started, to suppress the rotational speed of planetary speed-reduction mechanism 4 at lower values. The rotational speed of one-way clutch 6b can be also suppressed at lower values, improving the durability of one-way clutch 6b. It also possible to suppress vibrations occurring from the unbalance of components in the planetary speed-reduction mechanism 4. Noise reduction and durability of bearings and clutches can be greatly improved.

Yet further, the embodiments of the present invention dispose both the one-way clutch 6b for use in the engine start-up phase and the one-way clutch 6a for use in the generating phase in a hollow space available inside the drive shaft 7. This is an effective arrangement to reduce the number of parts, and to reduce the size, and also to reduce the assembling time.

Still further, the embodiments of the present invention provide a lubrication oil supply arrangement for effectively supplying engine oil to the frictional elements in the apparatus. Thus, durability of these frictional elements can be improved, lowering noises and increasing the rustproofing ability.

Cooling down armature 2 by engine oil makes it possible to further reduce the size and weight of the apparatus. Vibrations and noises, occurring due to the unbalance of armature 2 when it is rotating, can be suppressed by the viscosity of oil. Similarly, engine vibrations can be suppressed effectively.

Utilizing engine oil as cooling fluid is useful to simplify the cooling mechanism. Although the embodiments of the present invention use engine oil as cooling fluid, it will be possible to use the engine cooling water. Similar functions and effects will be expected.

Introduction passages of cooling fluid are formed in both the engine block 12 and the starter/dynamo frame 9 which are hermetically sealed with each other. Hence, no piping arrangement is specially required. Installation is easy. The number of parts is reduced. Anti-vibration ability and heat radiation ability are both improved.

As the starter relay 16 is fixed to the starter/dynamo, it is possible to maintain the compatibility with the conventional starter system.

Next, an internal speed-reduction ratio of the starter/dynamo will be explained.

$N_{SM}$ represents a rotational speed of the starter/dynamo at the maximum output, when it is used as a starter (shunt motor). $N_{MS}$ is approximately a half of a no-load speed $N_{SN}$. When the starter/dynamo is used as a dynamo, it is mandatorily necessary to start the electric power generation from an engine idling speed $N_I$. Accordingly, an effective use of the starter/dynamo is realized by the following settings.

The maximum output of the starter is obtained at the engine minimum speed Ne.

The engine idling speed $N_I$ is equal to the no-load speed $N_{SN}$.

From the above conditions, the internal speed-reduction ratio "i" is derived from the following equations.

$$Ne=N_{SM}\times(1/ie)\times(1/i)$$

$$N_I=N_{SN}\times(1/ie)$$

$$N_{SN}=2\ N_{SM}$$

$$i = \frac{N_{SM}}{ie}\cdot\frac{1}{Ne}=\frac{N_{SN}}{2ie}\cdot\frac{1}{Ne} = \frac{N_I\cdot ie}{2ie}\cdot\frac{1}{Ne}=\frac{N_I}{2Ne}$$

where "ie" represents a gear ratio of the ring gear 8 to the gear portion 7b of drive shaft 7.

Accordingly, the starter/dynamo can be effectively operated by setting the internal speed-reduction ratio to ½ of the ratio of the engine idling speed $N_I$ (i.e. engine self-sustaining minimum speed) to the engine firing speed Ne (i.e. engine firing minimum speed).

In a practical use, the engine firing speed (minimum speed: Ne) is in a range of 30 to 100 rpm, while the engine idling speed $N_I$ is in a range of 400 to 800 rpm. Hence, the above-described equations can be established in ordinary automotive vehicles.

Normally, the internal speed-reduction ratio of the starter is in a range from 4 to 6. Therefore, the starters can be effectively operated using conventional specifications. If the minimum engine speed Ne is lowered, the speed-reduction ratio of the starter/dynamo can be further increased by determining the ratio according to the above-described conditions. The size and weight of the starter/dynamo can be further reduced.

As this invention may be embodied in several forms without departing from the spirit of essential characteristics thereof, the present embodiments described are therefore intended to be only illustrative and not restrictive, since the scope of the invention is defined by the appended claims rather than by the description preceding them, and all changes that fall within metes and bounds of the claims, or equivalents of such metes and bounds, are therefore intended to be embraced by the claims.

What is claimed is:

1. A combined starter and generator comprising:

a rotor having a rotary shaft;

a drive shaft provided around an outer periphery of said rotary shaft and rotatably supported on a housing, said drive shaft having substantially the same axial center as said rotary shaft and having a pinion gear meshing with a ring gear of an engine;

a speed-reduction mechanism including a sun gear provided on said rotary shaft, a planetary gear meshing with said sun gear, and an internal gear meshing with said planetary gear;

a reduction shaft receiving a rotational torque transmitted from said rotor through said speed-reduction mechanism;

a first one-way clutch interposed between said reduction shaft and said drive shaft for connecting said reduction shaft to said drive shaft only when any rotational torque is transmitted from said reduction shaft to said drive shaft;

a second one-way clutch interposed between said drive shaft and said rotary shaft for connecting said drive shaft to said rotary shaft only when any rotational torque is transmitted from said drive shaft to said rotary shaft, said second one-way clutch being radially positioned inside said pinion gear of said drive shaft, whereby, in a start-up operation of said engine, rotation of said rotor is reduced through said speed-reduction mechanism, and transmitted through said reduction shaft, said first one-way clutch and said drive shaft to said ring gear to drive said engine, while, after succeeding said start-up operation, rotation of said ring gear of said engine is transmitted through said drive shaft and said second one-way clutch to said rotary shaft of said rotor to generate electric power.

2. The combined starter and generator in accordance with claim 1, wherein said pinion gear and said ring gear are constituted by helical gears or double-helical gears.

3. The combined starter and generator in accordance with claim 2, further comprising a lubrication oil supply means for supplying lubrication oil to frictional surfaces of said pinion gear and said ring gear.

4. The combined starter and generator in accordance with claim 3, wherein said lubrication oil supply means comprises an oil reservoir having an upper opening and formed integrally with said housing, said oil reservoir being disposed under said ring gear and covering said pinion gear.

5. The combined starter and generator in accordance with claim 2, wherein said lubrication oil supply means comprises an oil reservoir having an upper opening and formed integrally with said housing, said oil reservoir being disposed under said ring gear and covering said pinion gear.

6. The combined starter and generator in accordance with claim 1, further comprising a lubrication oil supply means for supplying lubrication oil to frictional surfaces of said pinion, gear and said ring gear.

7. The combined starter and generator in accordance with claim 6, wherein said lubrication oil supply means comprises an oil reservoir having an upper opening and formed integrally with said housing, said oil reservoir being disposed under said ring gear and covering said pinion gear.

8. The combined starter and generator in accordance with claim 6, wherein said rotor is stored in a rotor accommodating space into which lubrication oil is supplied.

9. The combined starter and generator in accordance with claim 8, wherein said housing is connected to an engine block, and said rotor accommodating space is communicated with a lubrication oil passage in said engine block through a lubrication passage opened on a connecting surface of said housing.

10. The combined starter and generator in accordance with claim 3, further comprising a rotor speed restricting means for preventing the speed of said rotor from exceeding a predetermined upper limit.

11. The combined starter and generator in accordance with claim 10, wherein said rotor speed restricting means is formed integrally with said second one-way clutch.

12. The combined starter and generator in accordance with claim 1, wherein said rotor is accommodated in a rotor accommodating space into which lubrication oil is supplied.

13. The combined starter and generator in accordance with claim 12, wherein said housing is connected to an engine block, and said rotor accommodating space is communicated with a lubrication oil passage in said engine block through a lubrication passage opened on a connecting surface of said housing.

14. The combined starter and generator in accordance with claim 1, further comprising a rotor speed restricting means for preventing the speed of said rotor from exceeding a predetermined upper limit.

15. The combined starter and generator in accordance with claim 14, wherein said rotor speed restricting means is formed integrally with said second one-way clutch.

16. The combined starter and generator in accordance with claim 15, wherein said rotor speed restricting means comprises:

a tube engaged with said rotary shaft of said rotor so as to cause no rotational displacement therebetween but allowing a mutual displacement therebetween in an axial direction, said tube being engaged with an inner conical surface of said pinion gear through a clutch roller so as to receive a rotational torque from said pinion gear but transmitting no torque to said pinion gear;

a weight having a slant face mating with a slant face formed on one end of said tube, said weight being engaged with said rotary shaft of said rotor so as to cause no rotational displacement therebetween but allowing a shift movement along said slant face of said tube;

first urging means for urging said weight in a centripetal direction;

second urging means for urging said weight along said slant face of said tube, wherein said tube has a conical surface brought into contact with said clutch roller, and a distance from a point on said conical surface to an axis of said tube increases with decreasing distance from said point to said slant face of said tube.

17. The combined starter and generator in accordance with claim 14, wherein said rotor speed restricting means comprises:

a tube engaged with said rotary shaft of said rotor so as to cause no rotational displacement therebetween but allowing a mutual displacement therebetween in an axial direction, said tube being engaged with an inner conical surface of said pinion gear through a clutch roller so as to receive a rotational torque from said pinion gear but transmitting no torque to said pinion gear;

a weight having a slant face mating with a slant face formed on one end of said tube, said weight being engaged with said rotary shaft of said rotor so as to cause no rotational displacement therebetween but allowing a shift movement along said slant face of said tube;

first urging means for urging said weight in a centripetal direction;

second urging means for urging said weight along said slant face of said tube, wherein said tube has a conical surface brought into contact with said clutch roller, and a distance from a point or said conical surface to an axis of said tube increases with decreasing distance from said point to said slant face of said tube.

18. A combined starter and generator comprising:

a rotor having a rotary shaft;

a drive shaft coupled around said rotary shaft and rotatably supported on a housing, said drive shaft being configured into a hollow cylinder having substantially the same axial center as said rotary shaft and having a pinion gear meshing with a ring gear of an engine;

a speed-reduction mechanism including a sun gear provided on said rotary shaft, a planetary gear meshing with said sun gear, and an internal gear meshing with said planetary gear;

a reduction shaft receiving a rotational torque transmitted from said rotor through said speed-reduction mechanism, said reduction shaft being configured into a hollow cylinder and coupled around said rotary shaft;

a first one-way clutch interposed between a cylindrical surface of said reduction shaft and a cylindrical surface of said drive shaft for connecting said reduction shaft to said drive shaft only when any rotational torque is transmitted from said reduction shaft to said drive shaft, a second one-way clutch interposed between an inner cylindrical surface of said drive shaft and an outer cylindrical surface of said rotary shaft for connecting said drive shaft to said rotary shaft only when any rotational torque is transmitted from said drive shaft to said rotary shaft, said second one-way clutch being radially positioned inside said pinion gear of said drive shaft, whereby, in a start-up operation of said engine, rotation of said rotor is reduced through said speed-reduction mechanism, and transmitted through said reduction shaft, said first one-way clutch and said drive shaft to said ring gear to drive said engine, while, after succeeding said start-up operation, rotation of said ring gear of said engine is transmitted through said drive shaft and said second one-way clutch to said rotary shaft of said rotor to generate electric power.

19. The combined starter and generator in accordance with claim 18, wherein said reduction shaft is disposed adjacently to said speed-reduction mechanism, and said first one-way clutch is interposed between an outer cylindrical surface of said reduction shaft and an inner cylindrical surface of said drive shaft, and said drive shaft is disposed adjacent to said reduction shaft.

20. A combined starter and generator comprising:

a rotor having a rotary shaft, wherein said rotor is accommodated in a rotor accommodating space into which lubrication oil is supplied;

a drive shaft provided around an outer periphery of said rotary shaft and rotatably supported on a housing, said drive shaft having substantially the same axial center as said rotary shaft and having a pinion gear meshing with a ring gear of an engine;

a speed-reduction mechanism including a sun gear provided on said rotary shaft, a planetary gear meshing with said sun gear, and an internal gear meshing with said planetary gear;

a reduction shaft receiving a rotational torque transmitted from said rotor through said speed-reduction mechanism;

a first one-way clutch interposed between said reduction shaft and said drive shaft for connecting said reduction shaft to said drive shaft only when any rotational torque is transmitted from said reduction shaft to said drive shaft; and a second one-way clutch interposed between said drive shaft and said rotary shaft for connecting said drive shaft to said rotary shaft only when any rotational torque is transmitted from said drive shaft to said rotary shaft, whereby, in a start-up operation of said engine, rotation of said rotor is reduced through said speed-reduction mechanism, and transmitted through said reduction shaft, said first one-way clutch and said drive shaft to said ring gear to drive said engine, while, after succeeding said start-up operation, rotation of said ring gear of said engine is transmitted through said drive shaft and said second one-way clutch to said rotary shaft of said rotor to generate electric power.

21. The combined starter and generator in accordance with claim 20, further comprising a lubrication oil supply means for supplying lubrication oil to frictional surfaces of said pinion gear and said ring gear.

22. The combined starter and generator in accordance with claim 21, wherein said housing is connected to an engine block, and said rotor accommodating space is communicated with a lubrication oil passage in said engine block through a lubrication passage opened on a connecting surface of said housing.

23. The combined starter and generator in accordance with claim 20, wherein said housing is connected to an engine block, and said rotor accommodating space is communicated with a lubrication oil passage in said engine block through a lubrication passage opened on a connecting surface of said housing.

24. A combined starter and generator comprising:

a rotor having a rotary shaft;

a drive shaft provided around an outer periphery of said rotary shaft and rotatably supported on a housing, said drive shaft having substantially the same axial center as said rotary shaft and having a pinion gear meshing with a ring gear of an engine;

a speed-reduction mechanism including a sun gear provided on said rotary shaft, a planetary gear meshing with said sun gear, and an internal gear meshing with said planetary gear;

a reduction shaft receiving a rotational torque transmitted from said rotor through said speed-reduction mechanism;

a first one-way clutch interposed between said reduction shaft and said drive shaft for connecting said reduction shaft to said drive shaft only when any rotational torque is transmitted from said reduction shaft to said drive shaft; and a second one-way clutch interposed between said drive shaft and said rotary shaft for connecting said drive shaft to said rotary shaft only when any rotational torque is transmitted from said drive shaft to said rotary shaft, whereby, in a start-up operation of said engine, rotation of said rotor is reduced through said speed-reduction mechanism, and transmitted through said reduction shaft, said first one-way clutch and said drive shaft to said ring gear to drive said engine, while, after succeeding said start-up operation, rotation of said ring gear of said engine is transmitted through said drive shaft and said second one-way clutch to said rotary shaft of said rotor to generate electric power;

said combined starter and generator further comprising a rotor speed restricting means formed integrally with said second one-way clutch, for preventing the speed of said rotor from exceeding a predetermined upper limit, wherein said rotor speed restricting means comprises:

a tube engaged with said rotary shaft of said rotor so as to cause no rotational displacement therebetween but allowing a mutual displacement therebetween in an axial direction, said tube being engaged with an inner conical surface of said pinion gear through a clutch roller so as to receive a rotational torque from said pinion gear but transmitting no torque to said pinion gear;

a weight having a slant face mating with a slant face formed on one end of said tube, said weight being engaged with said rotary shaft of said rotor so as to cause no rotational displacement therebetween but allowing a shift movement along said slant face of said tube;

first urging means for urging said weight in a centripetal direction; and second urging means for urging said weight along said slant face of said tube, wherein said tube has a conical surface brought into contact with said clutch roller, and a distance from a point on said conical surface to an axis of said tube increases with decreasing distance from said point to said slant face of said tube.

25. A combined starter and generator comprising:

a rotor having a rotary shaft;

a drive shaft provided around an outer periphery of said rotary shaft and rotatably supported on a housing, said drive shaft having substantially the same axial center as said rotary shaft and having a pinion gear meshing with a ring gear of an engine;

a speed-reduction mechanism including a sun gear provided on said rotary shaft, a planetary gear meshing with said sun gear, and an internal gear meshing with said planetary gear;

a reduction shaft receiving a rotational torque transmitted from said rotor through said speed-reduction mechanism;

a first one-way clutch interposed between said reduction shaft and said drive shaft for connecting said reduction shaft to said drive shaft for connecting said reduction shaft to said drive shaft only when any rotational torque is transmitted from said reduction shaft to said drive shaft; and a second one-way clutch interposed between said drive shaft and said rotary shaft for connecting said drive shaft to said rotary shaft only when any rotational torque is transmitted from said drive shaft to said rotary shaft, whereby, in a start-up operation of said engine, rotation of said rotor is reduced through said speed-reduction mechanism, and transmitted through said reduction shaft, said first one-way clutch and said drive shaft to said ring gear to drive said engine, while, after succeeding said start-up operation, rotation of said ring gear of said engine is transmitted through said drive shaft and said second one-way clutch to said rotary shaft of said rotor to generate electric power;

said combined starter and generator further comprising a rotor speed restricting means for preventing the speed of said rotor from exceeding a predetermined upper limit, wherein said rotor speed restricting means comprises:

a tube engaged with said rotary shaft of said rotor so as to cause no rotational displacement therebetween but allowing a mutual displacement therebetween in an axial direction, said tube being engaged with an inner conical surface of said pinion gear through a clutch roller so as to receive a rotational torque from said pinion gear but transmitting no torque to said pinion gear;

a weight having a slant face mating with a slant face formed on one end of said tube, said weight being engaged with said rotary shaft of said rotor so as to cause no rotational displacement therebetween but allowing a shift movement along said slant face of said tube;

first urging means for urging said weight in a centripetal direction; and second urging means for urging said weight along said slant face of said tube, wherein said tube has a conical surface brought into contact with said clutch roller, and a distance from a point on said conical surface to an axis of said tube increases with decreasing distance from said point to said slant face of said tube.

* * * * *